US005947787A

United States Patent [19]

Cyrus et al.

[11] Patent Number: 5,947,787

[45] Date of Patent: Sep. 7, 1999

[54] MODULAR LATTICE SUBSTRUCTURE FOR A TOY BUILDING SET

[75] Inventors: Peter Cyrus; Sean Cryan; Steve Proctor; Rich Franko, all of Seattle; Chris Brady, Bothell; David Wicklander, Seattle; Gary Franz, Seattle; William Burns, Seattle; Matt Gibson, Spokane, all of Wash.

[73] Assignee: Parvia Corporation, Seattle, Wash.

[21] Appl. No.: 08/936,269

[22] Filed: Sep. 24, 1997

[51] Int. Cl.[6] ..... A63H 33/08; A63H 3/52

[52] U.S. Cl. ..... 446/127; 446/105; 446/476

[58] Field of Search ..... 446/127, 128, 446/124, 476, 478, 120, 121, 122, 105, 107

[56] References Cited

U.S. PATENT DOCUMENTS

| | | | |
|---|---|---|---|
| D. 304,484 | 11/1989 | Knudsen . | |
| D. 306,188 | 2/1990 | Tapdrup et al. . | |
| D. 306,190 | 2/1990 | Poulsen . | |
| D. 307,775 | 5/1990 | Pedersen . | |
| D. 366,914 | 2/1996 | Frederiksen . | |
| D. 367,896 | 3/1996 | Knudsen . | |
| D. 367,897 | 3/1996 | Schmidt et al. . | |
| 1,393,163 | 10/1921 | Rasely . | |
| 1,985,032 | 12/1934 | Hoult | 446/122 |
| 2,406,759 | 9/1946 | Glukes . | |
| 2,619,829 | 12/1952 | Tatum | 446/127 X |
| 2,674,813 | 4/1954 | Hutchinson . | |
| 2,676,420 | 4/1954 | Berg . | |
| 2,871,619 | 2/1959 | Walters . | |
| 2,907,137 | 10/1959 | Ehrmann | 446/127 |
| 2,942,354 | 6/1960 | Grain . | |
| 3,005,282 | 10/1961 | Christiansen . | |
| 3,025,626 | 3/1962 | Schumacher . | |
| 3,034,254 | 5/1962 | Christiansen . | |
| 3,132,443 | 5/1964 | Kuhn . | |
| 3,162,973 | 12/1964 | Christiansen . | |
| 3,168,793 | 2/1965 | Gibson | 446/127 |
| 3,233,358 | 2/1966 | Dehm | 446/128 X |
| 3,234,683 | 2/1966 | Christiansen . | |
| 3,236,004 | 2/1966 | Christiansen . | |
| 3,242,610 | 3/1966 | Christiansen . | |
| 3,284,946 | 11/1966 | Christiansen . | |
| 3,352,054 | 11/1967 | Glass et al. . | |
| 3,461,601 | 8/1969 | Kristiansen . | |
| 3,475,851 | 11/1969 | Christiansen . | |
| 3,597,858 | 8/1971 | Ogsbury . | |
| 3,597,875 | 8/1971 | Christiansen . | |
| 3,667,153 | 6/1972 | Christiansen . | |
| 3,742,620 | 7/1973 | Knoll . | |
| 3,981,506 | 9/1976 | Daniel et al. . | |
| 4,028,844 | 6/1977 | Dideriksen et al. . | |
| 4,035,947 | 7/1977 | Burge | 446/127 |
| 4,176,493 | 12/1979 | Dideriksen . | |
| 4,185,410 | 1/1980 | Kristiansen . | |
| 4,202,132 | 5/1980 | Fischer | 446/127 |

(List continued on next page.)

FOREIGN PATENT DOCUMENTS

| | | | |
|---|---|---|---|
| 184497 | 1/1956 | Austria | 446/128 |
| 2056230 | 5/1972 | Germany | 446/127 |
| 2429491 | 1/1975 | Germany . | |
| 2711724 | 9/1978 | Germany | 446/128 |
| 3620379 | 12/1987 | Germany . | |
| 477823 | 1/1953 | Italy . | |
| 6615085 | 6/1967 | Netherlands | 446/127 |
| 8101581 | 10/1982 | Netherlands | 446/122 |
| 385086 | 2/1965 | Switzerland | 446/128 |
| 890608 | 3/1962 | United Kingdom . | |

*Primary Examiner*—D. Neal Muir

*Attorney, Agent, or Firm*—Christensen O'Connor Johnson & Kindness PLLC

[57] ABSTRACT

The modular lattice substructure for a playing structure, such as a toy building set, includes elongate beams, elongate joists, and columns having a height greater than the height of the elongate beams and joists. The sides of the columns have a protrusion connector removably attachable to a slot connector in the ends of the elongate beams and the ends of the elongate joists.

4 Claims, 9 Drawing Sheets

U.S. PATENT DOCUMENTS 4,203,248 5/1980 Tapdrup .
4,205,482 6/1980 Christiansen et al. .
4,214,403 7/1980 Knudsen .
4,245,400 1/1981 Johnson .
4,403,733 9/1983 Bach et al. .
4,430,063 2/1984 Bach et al. .
4,430,826 2/1984 Ryaa .
4,461,116 7/1984 Bach .
4,556,393 12/1985 Bolli .
4,579,041 4/1986 Organ et al. .
4,589,702 5/1986 Bach et al. .
4,624,647 11/1986 Munnix ..... 446/127 X
4,685,884 8/1987 Rohan .
4,715,832 12/1987 Bach .
4,726,515 2/1988 Bolli et al. .
4,743,202 5/1988 Bach .
4,846,750 7/1989 Tapdrup .
4,854,742 8/1989 Bach .
4,861,306 8/1989 Bolli et al. .
4,874,176 10/1989 Auerbach .
4,883,440 11/1989 Bolli .
4,894,040 1/1990 Bach et al. .
4,895,544 1/1990 Fischer ..... 446/122
4,895,548 1/1990 Holland et al. ..... 446/476
4,897,066 1/1990 Tapdrup et al. .
4,932,916 6/1990 Blickle ..... 446/137 X
4,937,181 6/1990 Rogers .
4,978,301 12/1990 Dodge .
4,988,322 1/1991 Knudsen .
4,988,324 1/1991 Ryaa et al. .
4,992,069 2/1991 Bolli et al. .
4,998,903 3/1991 Bolli et al. .
5,011,411 4/1991 Loewy .
5,015,210 5/1991 Dideriksen .
5,042,972 8/1991 Bach et al. .
5,049,078 9/1991 Thomsen .
5,049,104 9/1991 Olsen .
5,071,384 12/1991 Poulsen .
5,087,001 2/1992 Bolli et al. .
5,094,643 3/1992 Bolli et al. .
5,112,263 5/1992 Penillard et al. .
5,251,900 10/1993 Gallant .
5,304,086 4/1994 Bolli et al. .
5,322,466 6/1994 Bolli et al. .
5,326,267 7/1994 Brokaw .
5,348,478 9/1994 Bradshaw .
5,349,734 9/1994 Poulsen et al. .
5,360,364 11/1994 Poulsen et al. .
5,373,791 12/1994 Bach et al. .
5,378,191 1/1995 Ryaa .
5,380,232 1/1995 Berggreen et al. .
5,387,148 2/1995 Dideriksen et al. .
5,417,603 5/1995 De Chazal .
5,427,530 6/1995 Taggart .
5,427,558 6/1995 Knudsen et al. .
5,493,816 2/1996 Willemsen .
5,494,471 2/1996 Ryaa et al. .
5,580,295 12/1996 Ruzskai et al. .
5,596,181 1/1997 Bach et al. .
5,643,038 7/1997 Olsen et al. .
5,645,463 7/1997 Olsen .

20
12
32
42
44
50
62
80

MODULAR LATTICE SUBSTRUCTURE FOR A TOY BUILDING SET

FIELD OF THE INVENTION

The invention relates to substructures for toy building sets and, more particularly, to modular lattices supporting toy building sets.

BACKGROUND OF THE INVENTION

In U.S. Pat. No. 5,427,530, a portable water pollution model and method are disclosed that provide an improved device and method for simulating water pollution. This invention includes a portable simulated watershed model, including a simulated body of water and a simulated water pollution source; a simulated water pollutant, placeable on selected portions of the model; a simulated best management practice for pollution minimization, placeable on selected portions of the model; and a fluid dispenser capable of simulating rain over the watershed model. This invention further includes a method for simulating water pollution including providing a portable simulated watershed model, providing a simulated water pollutant, placing the simulated pollutant on selected portions of the model, providing a simulated best management practice, placing the simulated practice on selected portions of the model, and simulating rain over the model.

In U.S. Pat. No. 5,417,603, a playing structure includes a plurality of playing structure modules connectable together to form an array having a generally continuous, visually fluid, three-dimensional playing surface. Each playing structure module has a reversible top to allow the topography of the playing surface to be changed. The top of each playing structure module has a different three-dimensional topography on either side thereof. Each playing structure module may have a different or the same top. The playing surfaces have a coloured landscape painted thereon to depict lakes, countrysides, roadways etc. and the like. The topography of the playing surfaces and the painted landscapes are designed so that the certain symmetries exist. In particular, when a plurality of playing structure modules are assembled to form an array and the tops of the playing structure modules are arranged to provide a playing surface having a continuous, visually fluid landscape, any one of or all of the tops can be reversed along a diagonal and the landscape of the resulting playing surface will still be continuous and visually fluid. This of course increases the number of different playing surfaces which can be created with the playing structure modules.

In U.S. Pat. No. 5,348,478, a modular terrain board is provided having a plurality of sections or terrain cell plugs which are held in place by a baseboard assembly having a corresponding plurality of cell receiving sections or cells formed therein. The terrain cell plugs can be easily removed to allow for quick and accurate reconfiguration of the terrain model. The terrain board has means for representing buildings, rivers, lakes, roads, and other topographical features.

In U.S. Pat. No. 5,326,267, model terrain accessories that are positioned for use on the surface of a miniature landscape are fabricated from a permanently flexible material, preferably polyvinyl chloride. These flexible accessories are realistically contoured models representing roads, streams, stream banks, earthworks, and walls, or segments thereof. These flexible accessories will conform to changes in surface elevation on any miniature landscape on which they are assembled. The flexible accessories fit together easily in an infinite variety of individual and group configurations, and can be easily removed from the landscape surface and reused when desired.

U.S. Pat. No. 5,251,900 discloses a puzzle formed of a plurality of puzzle pieces which, when assembled, create a self-standing, three-dimensional building structure. The puzzle pieces are of irregular, polygonal shape, but all puzzle pieces are flat, planar blocks. The blocks are releasably interlocked about a common plane with first, edgewise, complementary dovetail joints. For interlocking puzzle walls that are transverse to one another, second, straight U-shape, edgewise, complementary tenon and mortise joints are further provided edgewisely of those corner blocks for frictional interlocking. Thus, no separate pin, bent units or the like are required to anchor the corner portions of the three dimensional structure. The self-standing, enclosing structure is continuous, and shows a continuous image on its external face.

U.S. Pat. No. 5,011,411 discloses a method making a non-repetitive modular design. The design is created by assembling a plurality of substantially identical modules to cover a surface. Each module has the shape of a polygon, especially a regular polygon, such as a square. The design of each module is created in the following manner. First, one selects a set of points, disposed symmetrically around the midpoint of a side of the polygon, and duplicates the same pattern of points for the remaining sides. Then, one connects every pair of points with a line, such that the lines so drawn form a pattern which is not symmetrical around any imaginary straight line joining any pair of vertices of the polygon. The spaces between lines, or between one or more lines and one or more sides of the polygon, can be filled in with a color, or with any other design element. To make the final design, one provides a plurality of such modules, and arranges them, with random orientations, to cover a surface. The design is non-repetitive, and any orientation of the individual modules will produce a valid design. The appearance of the design is varied by changing the orientation of one or more of the modules. In general, the appearance of the overall design is quite different from that of each of the modules. The modules made according to the invention can be used as floor tiles, or they can be otherwise secured permanently to a solid substrate for decorative purposes.

In U.S. Pat. No. 4,992,069, the plug-in building blocks of a building set have protruding connecting pins and corresponding mating connecting sockets. In order that bendproof trusses can also be built, the building set has single-row connecting bars with two terminal pins, whose spacing from one another amounts to $\sqrt{2}$ times an integral multiple of the modulus, and girder elements, which at two bordering sides faces each have a single row of pins with modular spacing and parallel to these side faces each have a projection set back by the thickness of the connecting bar. In this way, stable, aesthetically appealing trussings can be built with the building set.

In U.S. Pat. No. 4,988,322, a toy building set for building tree-like models comprises a trunk element and a branch element. The trunk element comprises a trunk portion and projecting branches having coupling means spaced from the trunk portion. The branch element comprises a plurality of connecting bars, at whose ends coupling bushings are provided. These bushings are formed with primary and secondary coupling means respectively, so that the branch elements may be interconnected and connected with the trunk elements. Preferably, said bars have additional branching portions whose ends are provided with bushings similar to the coupling bushings.

U.S. Pat. No. 4,978,301 discloses a construction set suitable and safe for children of various ages comprising construction pieces and connector strips. The construction pieces have a semirigid planar construction with opposing major sides which have hook fastener material disposed on one side and loop pile fastener material disposed on the other. The fastener materials are of the type which adhere when pressed together. An outer border or margin area of the construction pieces is kept free of the fastener materials, to provide a tab or hem for separating attached pieces. The construction pieces have various shapes and sizes with which many designs and structures may be constructed. The connector strips have a similar construction to the construction pieces and are used to join adjacent construction pieces. The sides may include complementary colors and patterns.

U.S. Pat. No. 4,937,181 discloses an educational visual display system for teaching geography in which objects having some geographical or topographical significance, e.g., states of the Union, may be detachably affixed and arranged to demonstrate relationship between the objects. The system includes a primary background surface of iron velvet fabric material to which hook type fasteners may be detachably adhered, a plurality of primary objects having geographical significance and comprising a soft foam core with a layer of iron velvet fabric on one side and a plurality of hook type fasteners on the other side, the primary objects being arrangeable to represent in combination a larger geographical unit, and a plurality of secondary objects each having geographical or topographical significance and having hook type fasteners on one side thereof for being detachably affixable to the layer of iron velvet fabric of the primary objects. The iron velvet fabric and the hook type fasteners function as an attachment pair similar to hook and loop fasteners sold under the tradename VELCRO®.

U.S. Pat. No. 4,874,176 discloses a three-dimensional puzzle including puzzle pieces having discrete surfaces, at least one surface of which has a three-dimensional sculpted form whereby the sculpted surfaces in the aggregate upon assembly of the puzzle form a continuous three-dimensional pictorial representation. Abutting sides of the puzzle pieces may be interlocking or three-dimensional for conformal abutting relation with the sides of opposed puzzle pieces. Filler pieces are also provided underlying the puzzle pieces for elevating the sculpted surfaces of the puzzle pieces. The puzzle pieces and filler pieces may be disposed on a base which may have an edge containment whereby non-interlocking puzzle and filler pieces may be used. The puzzle and filler pieces may be vertically interlocked against lateral movement and with respect to the base by projections received in corresponding recesses.

In U.S. Pat. No. 4,846,750, a base for a building set is provided with coupling studs for mounting building blocks having corresponding coupling elements. The base is further provided with cavities contoured to receive at least some of the building blocks. The cavities preferably extend from the side opposite the side provided with the coupling studs.

U.S. Pat. No. 4,743,202 discloses a toy building block having on one face thereof at least one row of mechanical coupling pins and opposite thereto mechanical counter-coupling tubes for coupling said toy building block to a similar toy building block either with the row of said coupling pins parallel to a corresponding row of coupling pins of said similar block or perpendicular to said corresponding row. The toy building block includes first and second current paths connected to first and second contact areas respectively designed to establish electrical connection with first and second contact areas in a similar block. The first and second contact areas are disposed in first and second angular sectors about adjacent coupling pins. The angular sectors are offset from each other and do not overlap regardless of whether the building block row of coupling pins is parallel or perpendicular to the row of coupling pins of the similar block.

U.S. Pat. No. 4,715,832 discloses a building element of the type which contains current-carrying components placed in the electrically insulated building block. There are provided at least two current-carrying components with respective contact areas which are mutually- co-axially positioned. The building blocks can be intercoupled mechanically while establishing electrical connection between the respective current rails in the cooperating building elements, without any risk of short circuiting between the two current-carrying components, no matter how the building blocks are intercoupled mechanically.

U.S. Pat. No. 4,685,884 discloses a multitude of parts of three-dimensional shape have full edges and also edge segments adapted for abutment with like edges and edge segments of other parts. The parts additionally include non-abutting irregular or curved edges which may represent terrain contour lines or the bank of a body of water. Inclined areas on the parts are adjacent the irregular or curved edges and represent sloped terrain which is continuous with like inclined areas on other abutting parts. The inclined area of a part may be dispensed with to provide a vertical surface to simulate an escarpment.

U.S. Pat. No. 4,556,393 discloses a building block having side walls and a perpendicular front with two rows of coupling pins on one side of the front face and counter-coupling tubes on the other side for mechanically coupling two building blocks by means of a clamping action. In each row, each second coupling pin has an electrically conducting surface, while the coupling pins lying between these are electrically insulating. One row of conducting pins is displaced in the direction of the rows by one coupling pin from the adjacent row. On the other side of the front wall a contact bar is arranged which is connected electrically with the conducting coupling pins of an associated row. The bar has a contact area for producing electrical contact with a row of conducting coupling pins of an adjacent, coupled building block.

U.S. Pat. No. 4,461,116 discloses a connecting member comprising an elastically deformable, tubular plug slitted at the ends for interconnecting pairs of building components, which have coupling holes to receive the ends of the connecting member. Apertures are in the plug wall between the slits. The plug wall is formed with lengthwise extending clamping wedges between the apertures. The clamping wedges have inclined faces which slope towards the ends of the connecting member and cause the connecting member to be compressed at the center and be expanded at the ends when it is pressed into a pair of co-axial holes in adjacent building components. The connecting member may in particular be formed with an annular flange and end beads which fit in corresponding annular grooves in a pair of adjacent components.

U.S. Pat. No. 4,245,400 discloses a three dimensional toy having a base member showing a housing development with structural profile members mounted thereon which are secured by profile locking elements for constructing elevations of roadways, lots and surrounding terrain. The profile members and locking elements also serve as retaining walls for soil which, when shaped to conform to the contours of the profile members and locking elements and provided with living plants defines the topography of a living housing development.

U.S. Pat. No. 4,185,410 discloses a suspension device for slideable and pivotal suspension of a base plate for toy building sets or base boards for visual planning panels. One face of the base plate or board is provided with rows of coupling studs including a plurality of studs uniformly spaced apart in both longitudinal and transverse directions, and the suspension device includes a gripping member having inwardly projecting guides adapted to slide along the base plate between a pair of rows of projections and to support the base plate when suspended on a wall. The device is further provided with a hinge member pivotally mounted on top of the gripping member, so as to provide for pivotal movements of the base plate relatively to a wall on which the base plate is mounted by means of the slideable suspension device.

U.S. Pat. No. 4,176,493 discloses a rotatable element comprising a base plate and a disc pivotally mounted in a circular aperture in the base plate. A socket for a pivot on the disc is located at the bottom of the plate and is supported thereon by ribs integral with the socket and with four side walls at the bottom of the base plate. Four identical apertures in the bottom of the base plate are formed by the socket, the ribs and the side walls. Four engagement studs are provided on the top face of the disc and extend beyond the periphery thereof. The underface of these studs provides for slideable contact with the top face of the base plate during the rotation of the disc.

In U.S. Pat. No. 3,981,506, a plurality of parallelepiped blocks having varying heights, planar sides and a curved upper surface are connected together by special pin and hole interlocks randomly spaced in predetermined locations to form a three dimensional puzzle with at least a curved upper surface. Two or more puzzles can be made by initially assembling the blocks into a polyhedron with six rectangular faces and sawing along a predetermined path to separate the polyhedron into individual puzzles.

In U.S. Pat. No. 3,742,620, there is provided an apparatus for demonstrating the inter-relationship of a landscape, and the contour lines representing said landscape in two- and three-dimensional representation. A transparent plate is supported over and free from the model and contour lines connecting points of the same height on the model are drawn upon the said plate using a substantially ablative transfer material, said contour lines are transferred onto transfer receiving material slabs and layers of the material corresponding to the contour lines are produced by cutting along the contour lines. The contour slabs are then stacked upon each other to give a three-dimensional representation of the model. In a further modification, the contour slabs are colored in such a manner that at least adjacent slabs are of a different color. Upon compression of the contour model by a transparent plate, a two-dimensional contour representation is again visible.

U.S. Pat. No. 3,667,153 discloses the coupling of two plate-shaped elements by means of an interlocking arrangement formed along the edges of the elements. The locking members of one element are in resilient engagement with identical locking members on the other element, the thickness of the individual locking members being half the thickness of the element, and the members being staggered alternately to one side and the other of a plane through the center of the edge parallel to the side faces of the element.

U.S. Pat. No. 3,597,875 discloses toy building blocks of similar shape but constructed to different modules. The inner protrusions of the smaller blocks coact with the outer projections of the larger blocks.

In U.S. Pat. No. 3,597,858, there is provided a plurality of building elements dimensionally related to conform to a selected scale having interlocking socket and beaded joint portions which may be assembled into a wide variety of composite structures including scale model buildings. The socket joint portion is slotted for insertion of the beaded joint portion and firmly grips the beaded joint portion to hold the elements in particular angular relation while at the same time permitting substantial forced rotational and sliding movement between elements. One of the elements is a flat panel which may be of a variety of geometric shapes and another of the elements is a connector of preselected lengths having plural joint portions arranged in angular spaced relation to one another about a common midpoint.

SUMMARY OF THE INVENTION

The modular lattice substructure for a playing structure, such as a toy building set, includes elongate beams, elongate joists, and columns having a height greater than the height of the elongate beams and joists. The sides of the columns have a protrusion connector removably attachable to a slot connector in the ends of the elongate beams and the ends of the elongate joists. The length of the elongate joists are less than the length of the elongate beams.

Preferably, each of the elongate beams are removably attachable to two of the columns, each of the elongate joists are removably attachable to two of the columns, and each of the columns are removably attachable to two of the elongate joists and two of the elongate beams such that the beams, joists, columns are in orthogonal relationship to form a parallelogram-shaped member that is removably connectable to other parallelogram-shaped members to form a support lattice.

The elongate beam has a protrusion connector located on a midpoint of each of its two sides for removable attachment to a slot connector on the ends of an elongate beam or another elongate joist that is orthogonally oriented.

In order to accommodate the vertical stacking of a plurality of modular lattice substructures, the top of the column has one of a male fitting thereon, and the bottom of the column and the bottom of the elongate beam have a female fitting thereon. Most preferably, these male fittings are clover leaf in shape that have an interference fit with square female fittings.

In one embodiment, the protrusion connector has a shaft with a width less than the width of the slot connector. The protrusion connector also has a head on the shaft with a width greater than the slot width. The shaft of the protrusion can thus pass into and out of the slot connector, but the head of the shaft cannot pass through the slot connector. In this manner, the elongate joists and elongate beams can be attached to the columns by sliding the shaft into the slot connector in a direction orthogonal to the longitudinal axis (e.g., upwardly) of the elongate beam or elongate joist. The elongate beam or the elongate joist cannot be removed from the column by pulling of the elongate beam or the elongate joist along the longitudinal axis thereof due to the broadened head on the shaft of the protrusion.

In another embodiment, the male protrusion connector has a shaft with a width less than the slot connector width. The protrusion connector has a head on the shaft with a length perpendicular to the shaft that is greater than the slot width, and with a width less than the slot connector width. The head of the protrusion connector can pass through the slot connector in a first position where the head width is parallel with the width of the slot connector. The elongate beam or elongate joist is moved along its longitudinal axis toward the column until the head and shaft of the protrusion connector pass through the slot connector. The elongate beam or the elongate joist is then rotated axially to a position such that the length of the head of the protrusion connector is parallel with the width of the slot connector, thus preventing separation of the elongate beam or joist from the column. A stop is located adjacent the slot connector to limit rotational movement of the head of the protrusion connector when the protrusion connector is oriented in the slot connector and rotated.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 3:
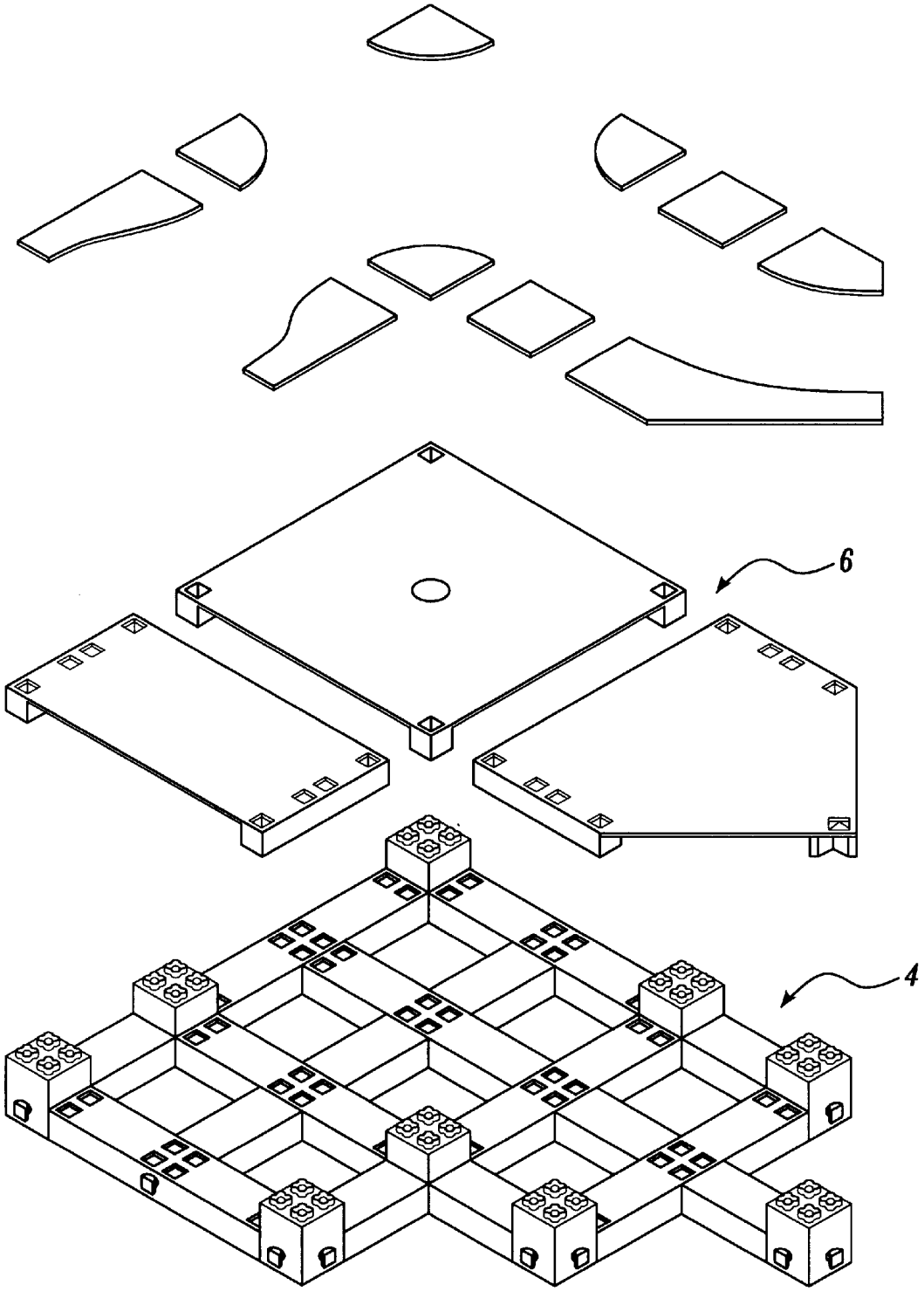
FIG. 3 is an exploded isometric view of the lattice and base of the modular toy building set embodying the present invention.
Figure 4:
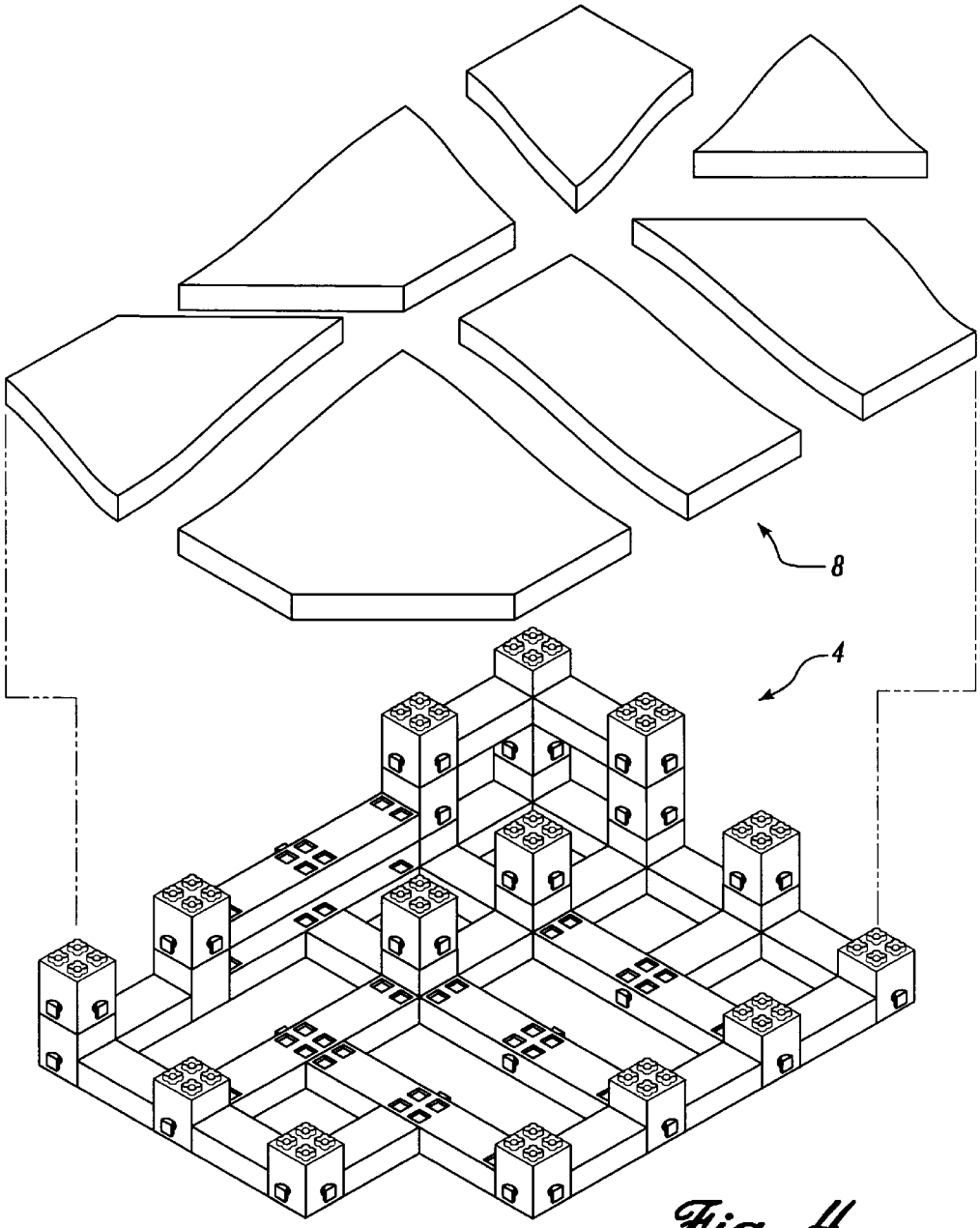
FIG. 4 is an exploded isometric view of the lattice and terrain of the modular toy building set embodying the present invention.

Referring to FIGS. 1–4, modular toy building set 2 generally includes lattice 4, base 6, terrain 8, and playing components 10. More specifically, lattice 4 supports, and is removably attachable to, base 6 as shown in FIG. 3. In turn, base 6 supports, and is removably attachable to playing components 10. Lattice 4 also supports, and is removably attachable to terrain 8, as shown in FIG. 4. The modular aspects of lattice 4, base 6, terrain 8, and playing components 10 allows a multitude of different configurations to be created with modular toy building set 2 while employing the same elements of lattice 4, base 6, terrain 8, and playing components 10. Lattice 4, base 6, terrain 8, and playing components 10 are preferably comprised of a synthetic polymer such as acrylonitrilebutadiene styrene (ABS). This synthetic polymer can be extruded or injection molded to form lattice 4, base 6, terrain 8, and playing components 10.

Figure 5:
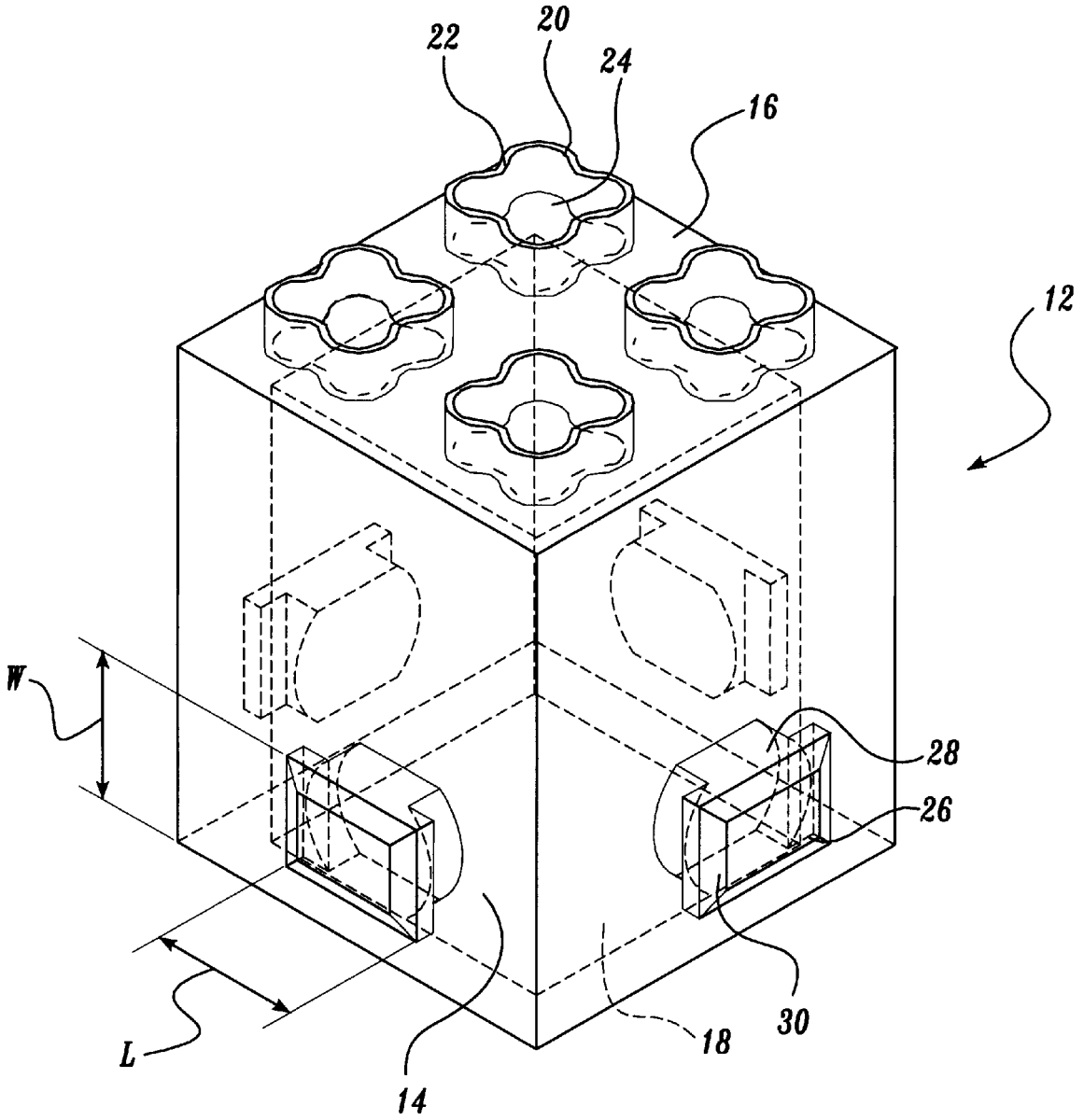
FIG. 5 is a isometric view of the column of the lattice of the modular toy building set embodying the present invention.

Referring to FIG. 5, column 12 of lattice 4 is shown in detail. Column 12 is substantially cubic in shape, but preferably has a height slightly greater than its width. Column 12 has four sides 14, a top 16, and a bottom 18. Male fittings 20 are preferably located on top 16 of column 12. Each male fitting 20 has a peripheral wall 22 and a center recess 24. Additionally, while male fittings 20 are shown on top 16 of column 12, male fittings 20 could, instead, be female fittings provided that the component to which top 16 of column 12 is to be attached has the appropriate mating fitting thereon. Similarly, as discussed throughout the rest of this description, wherever a female fitting (or conversely male fitting) is mentioned, a male fitting (or conversely a female fitting) can be employed in its stead as long as complementary fittings are present on components to be removably attached. Bottom 18 of column 12 preferably has a plurality of female fittings in the same configuration and orientation as the male fittings 20 on top 16 of column 12. The male fittings 20 on top 16 and the female fittings on bottom 18 of column 12 allow for secure, removable vertical stacking of a plurality of columns 12, as shown in FIG. 4, in order to vary the height of lattice 4. While male fittings 20 on top 16 of column 12 are substantially clover leaf in shape, the male fittings discussed herein, as well as the female fittings, can be of any shape that provides removable attachment of two components with a secure connection when attached. Each of sides 14 of column 12 preferably has a protrusion connector 26 thereon. Each protrusion connector 26 has a shaft 28, and a head 30 on the end of shaft 28. Protrusion connectors 26 are sized and shaped to mate with complementary slot connectors on other components in a manner further described below.

Figure 1:
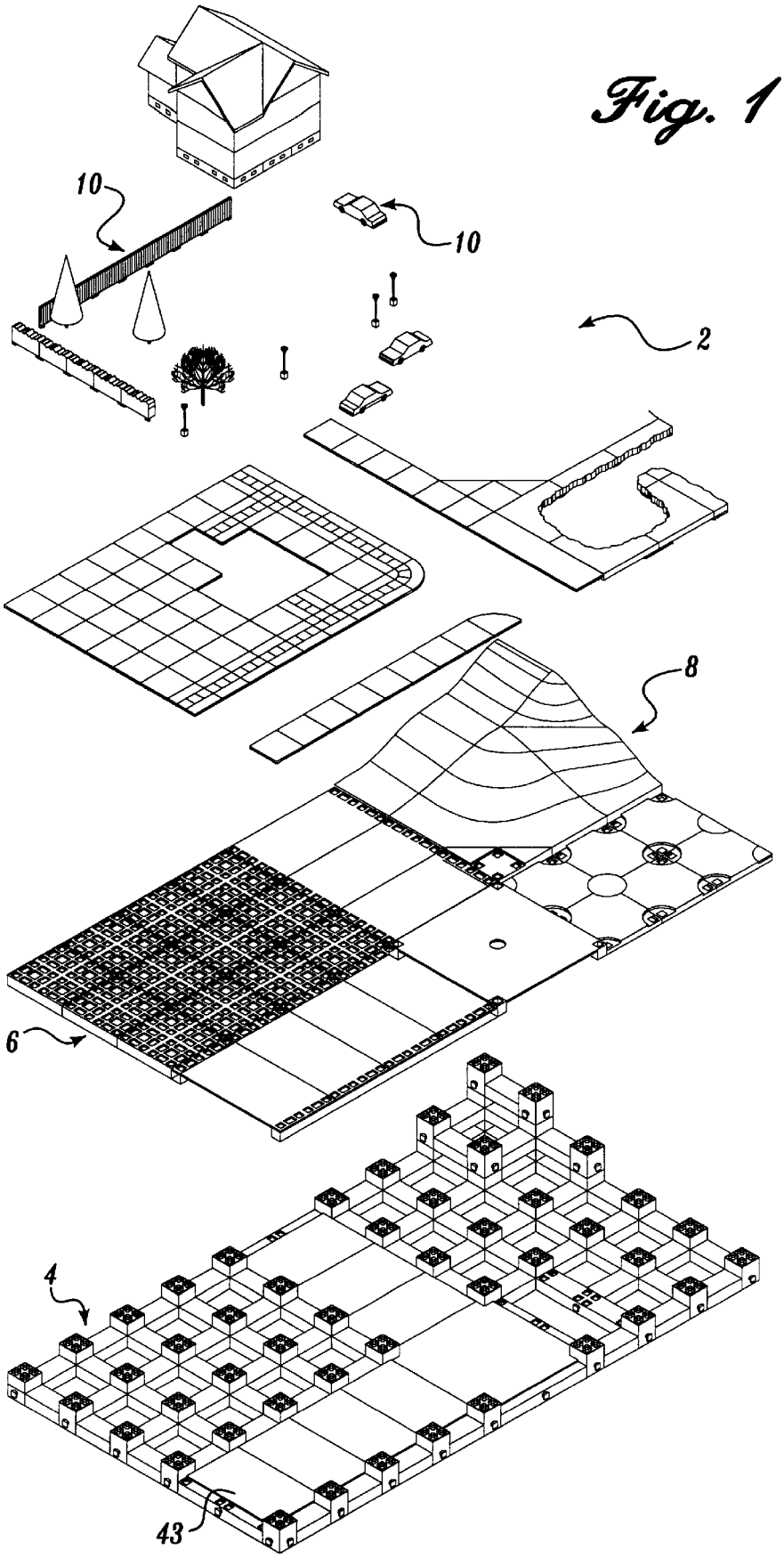
FIG. 1 is an exploded isometric view of the modular toy building set embodying the present invention.
Figure 2:
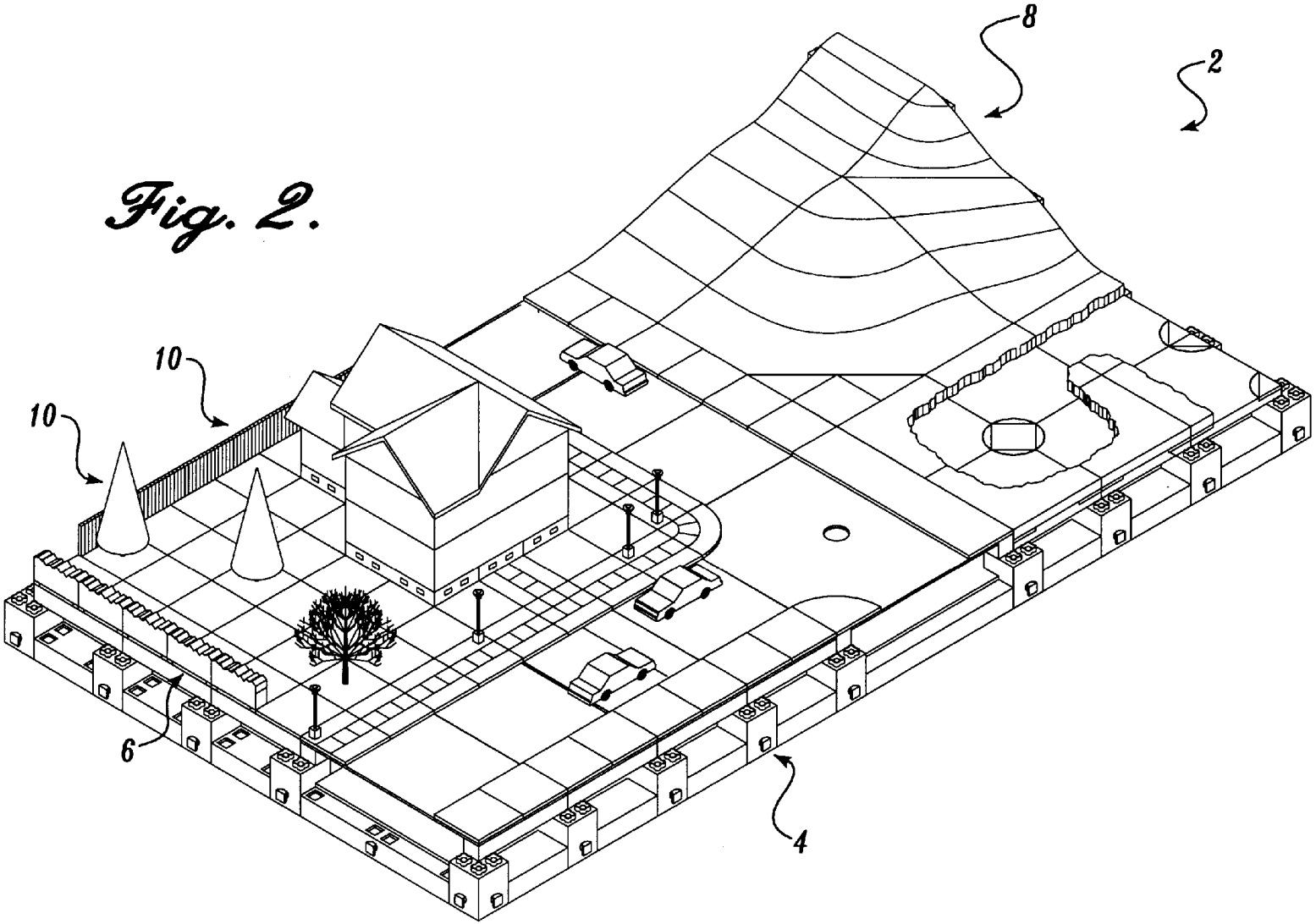
FIG. 2 is a isometric view of the modular toy building set embodying the present invention.
Figure 6:
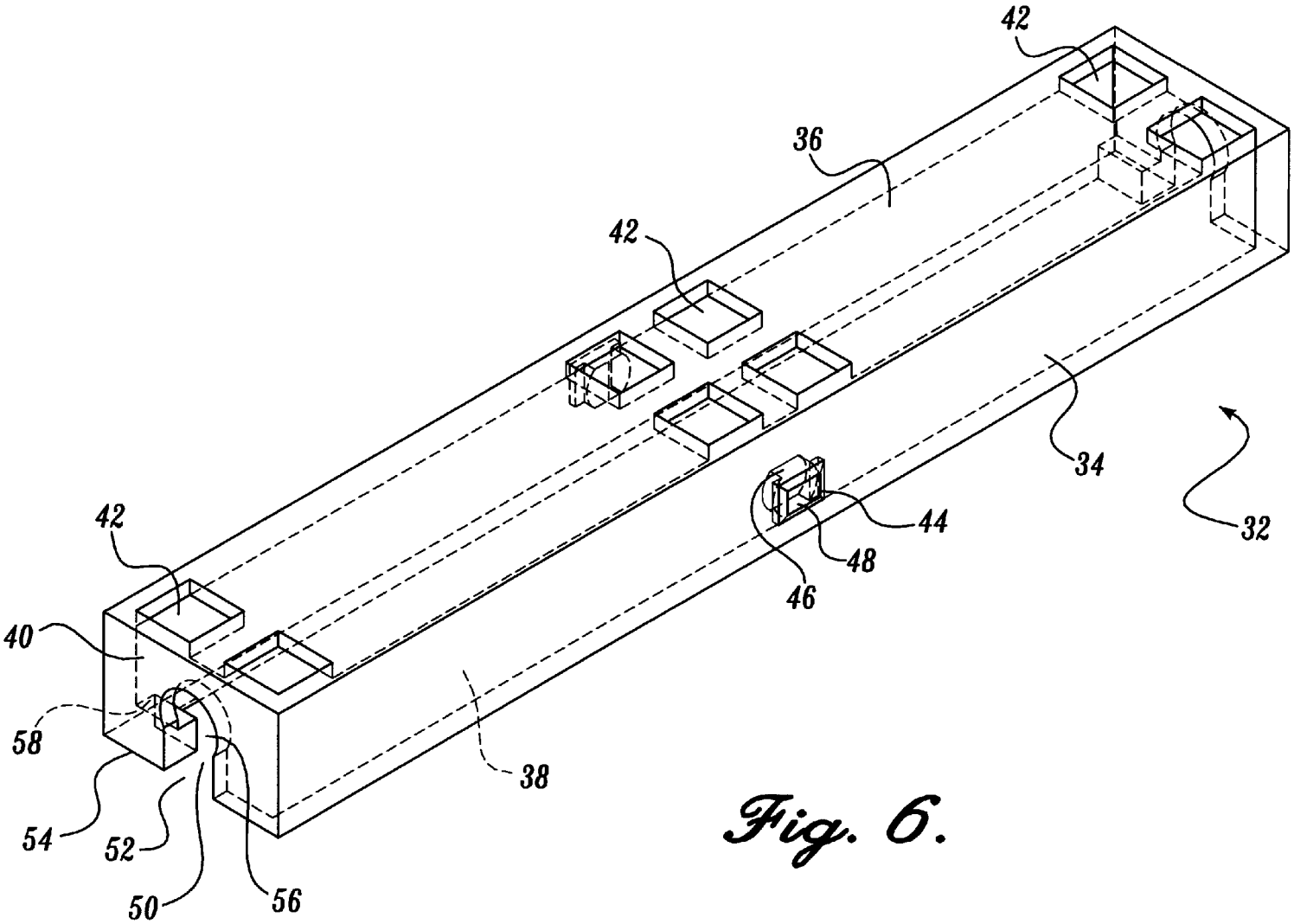
FIG. 6 is a isometric view of the beam of the lattice of the modular toy building set embodying the present invention.

Next, referring to FIG. 6, beam 32 is an elongate preferably rectangular member having sides 34, top 36, bottom 38, and ends 40. Beam 32 preferably has a height less than the height of column 12. Top 36 of beam 32 preferably has a plurality of female fittings 42 thereon. Most preferably, female fittings 42 are located in the center of top 36 and on each end of top 36. Still referring to FIG. 6, female fittings 42 are shown as having a substantially square cross section that has an interference fit with mating male fittings that can, for example, be clover leaf in shape. However, as stated above, female fittings 42 can have other shapes. Female fittings 42 can be employed to removably attach underground roadways 43, as shown in FIG. 1, that are straddled by adjacent columns 12. Underground roadways 43 have mating male fittings on the under surface thereof and allow movement of underground vehicles, or "moles" that guide transport of surface road vehicles by magnetic interconnection.

Again referring to FIG. 6, bottom 38 of beam 32 has a plurality of female fittings thereon such that beam 32 can be supported by columns 12. A protrusion connector 44 is preferably centrally located on each of sides 34 of beam 32. Each protrusion connector 44 has a shaft 46 with a head 48 thereon. Protrusion connector 44 is removably attachable to a slot connector on a component to be removably secured in a manner further described below. Slot connector 50 is located in end 40 of beam 32. Slot connector 50 is an elongate opening having an entrance 52 in lower edge 54 of end 40 of beam 32. Entrance 52 is narrowed in relation to slot terminus 56 such that slot connector 50 can be generally described as being key hole in shape. Beam 32 is preferably at least partially hollow such that head stop 58 can be located within beam 32 adjacent entrance 52 of slot connector 50. Slot connector 50, and other slot connectors described below, while described herein as being an elongate key shaped slot, can generally be a receptive connector of any shape matable with a complementary protrusion connector.

Figure 7:
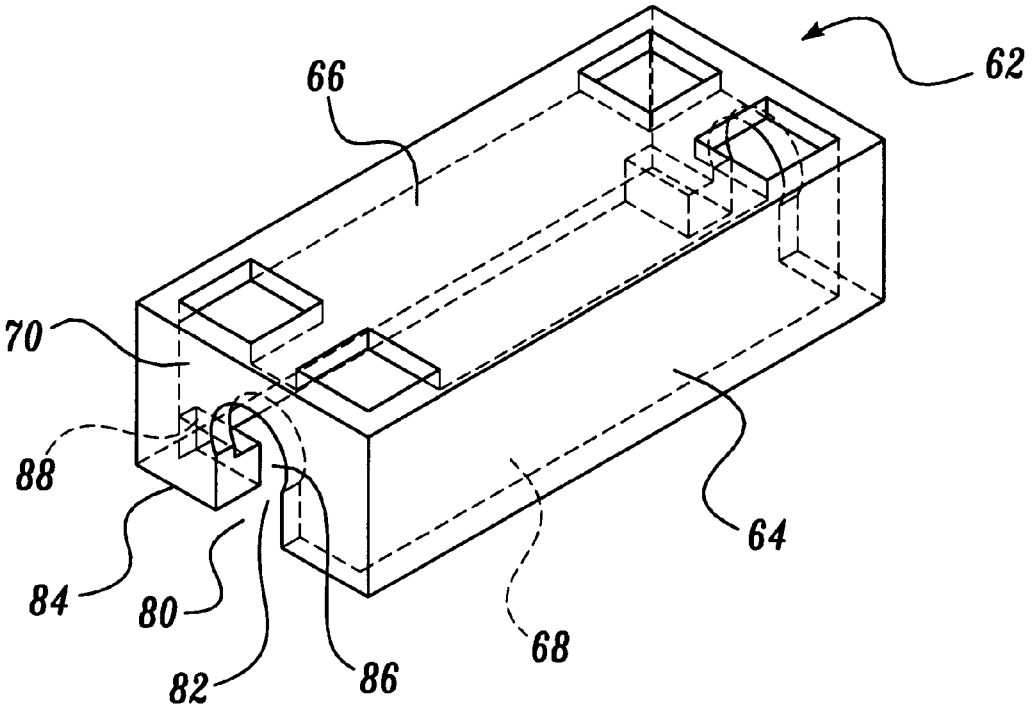
FIG. 7 is a isometric view of the joist of the lattice of the modular toy building set embodying the present invention.

Next, referring to FIG. 7, elongate joist 62 is a preferably rectangular member having a length somewhat less than the length, and preferably less than half the length, of elongate beam 32. Joist 62 is an elongate preferably rectangular member having sides 64, top 66, bottom 68, and ends 70. Joist 62 preferably has a height less than the height of column 12. Bottom 68 of joist 62 has a plurality of female fittings thereon such that joist 62 can be supported by columns 12. Slot connector 80 is located in end 70 of joist 62. Slot connector 80 is an elongate opening having an entrance 82 in lower edge 84 of end 70 of joist 62. Entrance 82 is narrowed in relation to slot terminus 86 such that slot connector 80 can be generally described as being key hole in shape. Joist 62 is preferably at least partially hollow such that head stop 88 can be located in joist 62 adjacent entrance 82 of slot connector 80.

Figure 8:
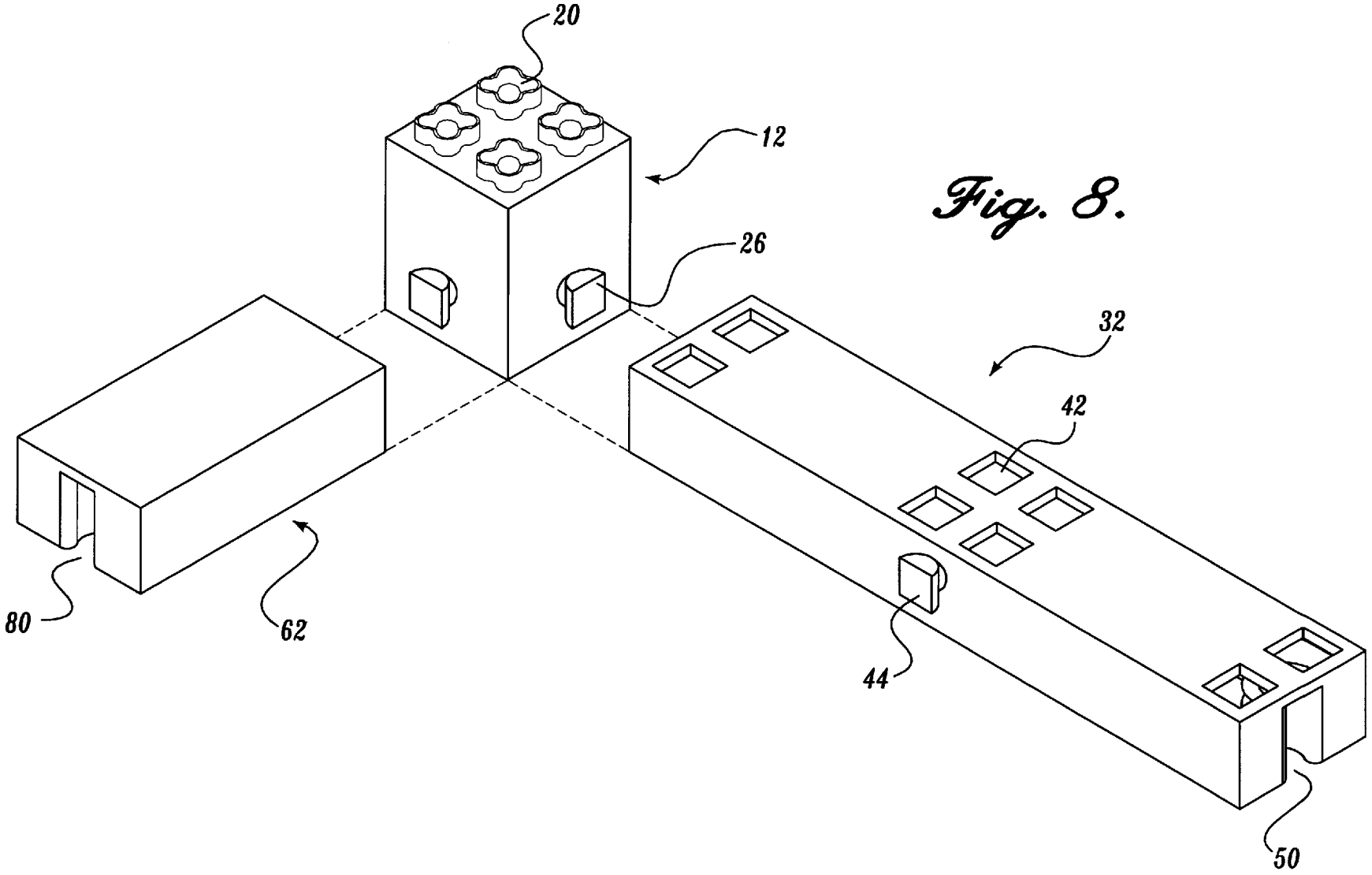
FIG. 8 is an exploded isometric view of the column, beam, and joist of the lattice of the modular toy building set embodying the present invention.
Figure 9:
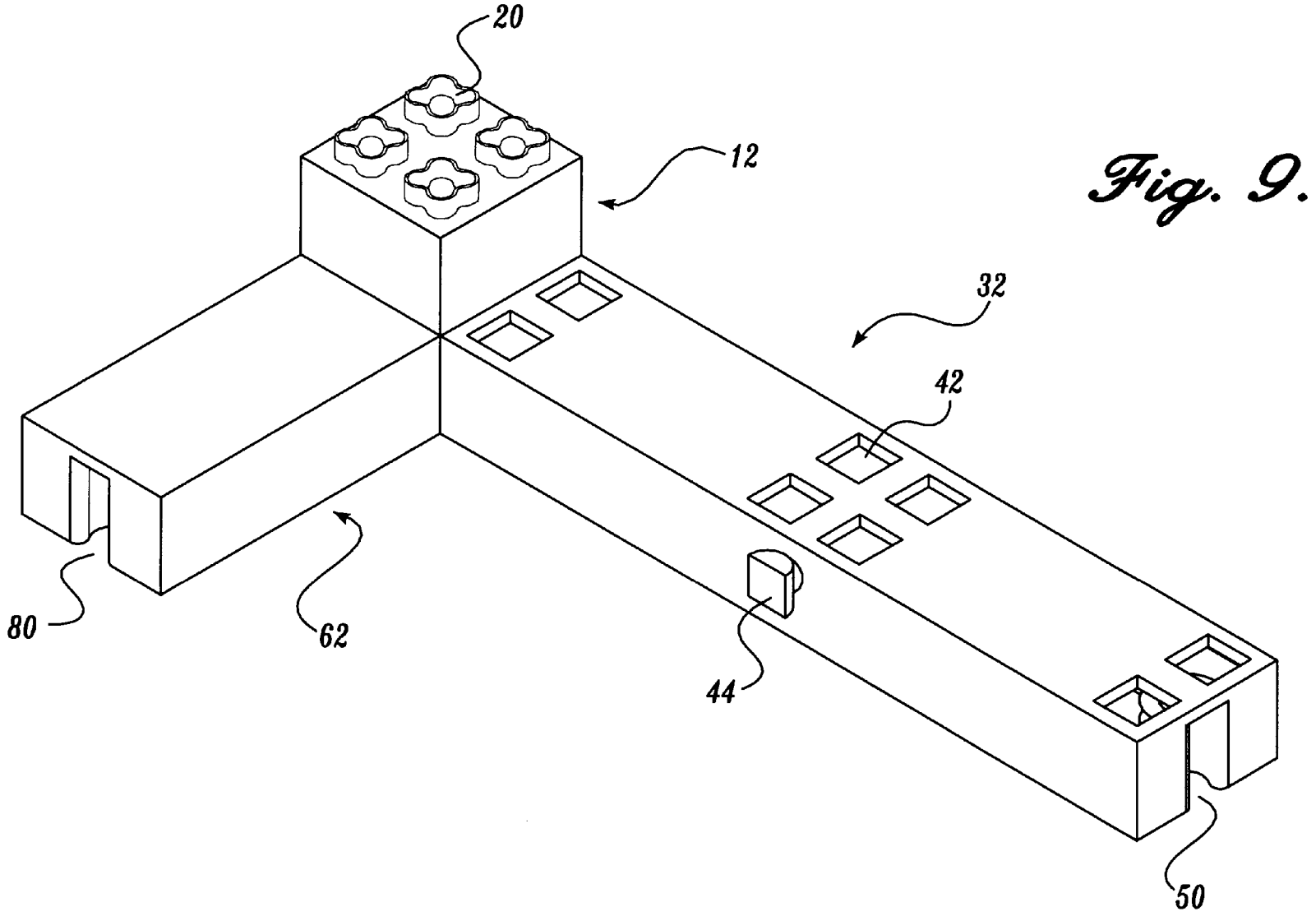
FIG. 9 is an isometric view of the column, beam, and joist of the lattice of the modular toy building set embodying the present invention.

Referring to FIGS. 5, 6, and 7, the interconnection of protrusion connector 26 of column 12 and protrusion connector 44 of beam 32 with slot connector 50 of beam 32 and slot connector 80 of joist 62 is now described in further detail. The interconnection of the above protrusion connectors 26 and 44 with the above slot connectors 50 and 80 is the basis for the removable connection of column 12, beam 32 and joist 62 as shown in FIGS. 8 and 9. In this manner, column 12 can be connected to beam 32 and/or joist 62. Beam 32 can be connected to column 12 and/or joist 62 and joist 62 can be connected to column 12 and/or beam 32. In a first embodiment, head stop 58 of beam 32 and head stop 88 of joist 62 are absent. Head 30 of protrusion connector 26 of column 12 and head 48 of protrusion connector 44 of beam 32 both have a width that is greater than the width of entrance 52 and terminus 56 of slot connector 50 of beam 32 and of entrance 82 and terminus 86 of slot connector 80 of joist 62. However, shaft 28 of protrusion connector 26 of column 12 and shaft 46 of protrusion connector 44 of beam 32 both have a width that is less than the width of entrance 52 and terminus 56 of slot connector 50 of beam 32 and of entrance 82 and terminus 86 of slot connector 80 of joist 62. Based on the above configurations, column 12 can be removably attached to beam 32 or joist 62 and beam 32 can be removably attached to another beam 32 or joist 62 by sliding shaft 28 of protrusion connector 26 of column 12 or shaft 46 of protrusion connector 44 of beam 32 through entrance 52 of slot connector 50 of beam 32 or entrance 82 of slot connector 80 of joist 62 in a direction orthogonal (e.g., upwardly) to the longitudinal axis of beam 32 or joist 62. Because the width of head 30 of protrusion connector 26 of column 12 and of head 48 of protrusion connector 44 of beam 32 is greater than the width of entrance 52 and terminus 56 of slot connector 50 of beam 32 and of entrance 82 and terminus 86 of slot connector 80 of joist 62, the beam 32 or joist 62 cannot be removed from column 12 or other beam 32 or joist 62 by pulling beam 32 or joist 62 along the longitudinal axis thereof.

In another embodiment, head stop 58 of beam 32 and head stop 88 of joist 62 are present. Additionally, as shown in FIG. 5, head 30 of protrusion connector 26 of column 12 and head 48 of protrusion connector 44 of beam 32 both have a length "l" that is greater than the width of entrance 52 and terminus 56 of slot connector 50 of beam 32 and of entrance 82 and terminus 86 of slot connector 80 of joist 62. However, head 30 of protrusion connector 26 of column 12 and head 48 of protrusion connector 44 of beam 32 both have a width "w" less than the width of terminus 56 of slot connector 50 of beam 32 and terminus 86 of slot connector 80 of joist 62. To removably attach beam 32 or joist 62 to column 12 or to removably attach beam 32 or joist 62 to another beam 32, joist 62 or beam 32 is first axially rotated 90° from the resting configurations shown in FIGS. 5 and 6 such that the width "w" of head 30 of protrusion connector 26 of column 12 or of head 48 of protrusion connector 44 of beam 32 is parallel with the width of entrance 52 and terminus 56 of slot connector 50 of beam 32 or of entrance 82 and terminus 86 of slot connector 80 of joist 62. Head 30 of protrusion connector 26 or head 48 of protrusion connector 44 can thus pass through either entrance 52 to terminus 56 of slot connector 50 or entrance 82 to terminus 86 of slot connector 80. Joist 62 or beam 32 is then rotated 90° back to the resting configuration shown in FIGS. 5 and 6, thus locking column 12 or beam 32 with a beam 32 or a joist 62 since greater length "l" of head 30 of protrusion connector 26 of column 12 or of head 48 of protrusion connector 44 of beam 32 is now parallel with the lesser width of either entrance 52 and terminus 56 of slot connector 50 of beam 32 or entrance 82 and terminus 86 of slot connector 80 of joist 62. Head stop 58 of beam 32 or head stop 88 of joist 62 prevents further rotational movement of head 30 of protrusion connector 26 of column 12 or head 48 of protrusion connector 44 of beam 32.

The above-described modular columns 12, beams 32 and joists 62, having varying heights and lengths, and facilitating both horizontal and vertical interconnection, allow for a multitude of lattice configurations having individual components orthogonally disposed with respect to each other.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A modular lattice substructure for a playing structure comprising:

(a) an elongate beam having an end, a height, and a length;

(b) a column having a side and a height greater than the height of said elongate beam, one of said end of said elongate beam and said side of said column having a protrusion connector removably attachable to a receptive connector on the other of said end of said elongate beam and said side of said column, wherein said receptive connector is a slot having a width, said protrusion connector is a protrusion having a shaft with a width less than said slot width, said protrusion having a head on said shaft with a length perpendicular to said shaft that is greater than said slot width and with a width less than said slot width such that said head of said protrusion can pass through said slot in a first position and cannot be removed from said slot when rotated to a second position; and (c) a stop adjacent said slot, said stop limiting rotational movement of said head of said protrusion when said protrusion is oriented in said slot and rotated to the second position.

2. A modular lattice substructure for a playing structure comprising:

(a) an elongate beam having two ends and a length;

(b) a column having four sides, said sides of said column having a protrusion connector removably attachable to a receptive connector on said ends of said elongate beam, wherein said receptive connector is a slot having a width, said protrusion connector is a protrusion having a shaft with a width less than said slot width, said protrusion having a head on said shaft with a length perpendicular to said shaft that is greater than said slot width and with a width less than said slot width such that said head of said protrusion can pass through said slot in a first position and cannot be removed from said slot when rotated to a second position; and (c) a stop adjacent said slot, said stop limiting rotational movement of said head of said protrusion when said protrusion is oriented in said slot and rotated to the second position.

3. A modular lattice substructure for a playing structure comprising:

(a) an elongate beam having an end and a length;

(b) a column having a side, one of said end of said elongate beam and said side of said column having a protrusion connector removably attachable to a receptive connector on the other of said end of said elongate beam and said side of said column;

(c) an elongate joist having an end and a length, said length of said elongate joist not being equal to said length of said elongate beam, said end of said elongate joist having one of a protrusion connector and a receptive connector for removable attachment to said side of said column, wherein said receptive connector is a slot having a width, said protrusion connector is a protrusion having a shaft with a width less than said slot width, said protrusion having a head on said shaft with a length perpendicular to said shaft that is greater than said slot width and with a width less than said slot width such that said head of said protrusion can pass through said slot in a first position and cannot be removed from said slot when rotated to a second position; and (d) a stop adjacent said slot, said stop limiting rotational movement of said head of said protrusion when said protrusion is oriented in said slot and rotated to the second position.

4. A modular lattice substructure for a playing structure comprising:

(a) an elongate beam having an end and a length;

(b) a column having a side, one of said end of said beam and said side of said column having a protrusion connector removably attachable to a receptive connector on the other of said end of said elongate beam and said side of said column, wherein one of said column and said elongate beam has an edge, said receptive connector is a slot having an entrance in said edge and said protrusion connector is a protrusion on the other of said column and said elongate beam oriented to pass through said entrance of said slot to reside in said slot, wherein said receptive connector is a slot having a width, said protrusion connector is a protrusion having a shaft with a width less than said slot width, said protrusion having a head on said shaft with a length perpendicular to said shaft that is greater than said slot width and with a width less than said slot width such that said head of said protrusion can pass through said slot in a first position and cannot be removed from said slot when rotated to a second position; and (c) a stop adjacent said slot, said stop limiting rotational movement of said head of said protrusion when said protrusion is oriented in said slot and rotated to the second position.

* * * * *